US010837259B2

(12) United States Patent
Reyes et al.

(10) Patent No.: US 10,837,259 B2
(45) Date of Patent: Nov. 17, 2020

(54) CLEANING CHANNELS

(71) Applicant: Baker Hughes Oilfield Operations LLC, Houston, TX (US)

(72) Inventors: Ever Mauricio Reyes, Pasadena, TX (US); Juan Carlos Mendoza, Pasadena, TX (US); Richard Michael Hatley, Morristown, NJ (US); Daniel James Knospler, Wantage, NJ (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 333 days.

(21) Appl. No.: 15/310,023

(22) PCT Filed: May 8, 2015

(86) PCT No.: PCT/US2015/029901
§ 371 (c)(1),
(2) Date: Nov. 9, 2016

(87) PCT Pub. No.: WO2015/172030
PCT Pub. Date: Nov. 12, 2015

(65) Prior Publication Data

US 2017/0268315 A1 Sep. 21, 2017

Related U.S. Application Data

(60) Provisional application No. 61/991,170, filed on May 9, 2014.

(51) Int. Cl.
*E21B 37/02* (2006.01)
*E21B 33/03* (2006.01)
(Continued)

(52) U.S. Cl.
CPC ..... *E21B 37/02* (2013.01); *B08B 9/035* (2013.01); *B08B 9/045* (2013.01); *E21B 33/03* (2013.01);
(Continued)

(58) Field of Classification Search
CPC ..... B08B 9/035; B08B 9/045; E21B 33/0355; E21B 37/02; E21B 37/00; E21B 33/03; E21B 34/16
See application file for complete search history.

(56) References Cited

U.S. PATENT DOCUMENTS 392,102 A * 10/1888 Butz ..... A46B 15/0002 15/105
2,254,677 A * 9/1941 Bortolo Festini .... A46B 13/001 15/179
(Continued)

FOREIGN PATENT DOCUMENTS

EP 0469058 A1 2/1992
EP 0636767 A1 2/1995
EP 2305948 A1 4/2011

OTHER PUBLICATIONS

International Search Report and Written Opinion issued in connection with corresponding PCT application PCT/US2015/029901 dated Jul. 29, 2015.

*Primary Examiner* — Alexander Markoff
(74) *Attorney, Agent, or Firm* — Mintz Levin Cohn Ferris Glovsky and Popeo, P.C.

(57) ABSTRACT

A method includes inserting a flexible cable into a cleaning region of a channel of a component via a cleaning port, rotating the flexible cable about an axis within the channel to interact a tip with deposits disposed within the cleaning
(Continued)

region of the channel, moving the flexible cable within the cleaning region of the channel along a length of the channel, and removing portions of the deposits from the cleaning region of the channel via a second port. The flexible cable includes the axis and the tip. A diameter of the tip is different than a diameter of the flexible cable. The tip is configured to loosen the portions of the deposits.

11 Claims, 12 Drawing Sheets

(51) Int. Cl.

| | |
|---|---|
| ***E21B 37/00*** | (2006.01) |
| ***B08B 9/035*** | (2006.01) |
| ***B08B 9/045*** | (2006.01) |
| ***E21B 33/035*** | (2006.01) |
| ***E21B 34/16*** | (2006.01) |

(52) U.S. Cl.
CPC ..... *E21B 33/0355* (2013.01); *E21B 34/16* (2013.01); *E21B 37/00* (2013.01)

(56) References Cited

U.S. PATENT DOCUMENTS

| | | | | |
|---|---|---|---|---|
| 3,380,094 | A * | 4/1968 | Comstock | B08B 7/024 15/93.1 |
| 5,301,061 | A * | 4/1994 | Nakada | A61B 1/00059 348/75 |
| 5,644,394 | A * | 7/1997 | Owens | B23P 6/002 15/324 |
| 5,813,089 | A | 9/1998 | Nolan | |
| 6,187,105 | B1 * | 2/2001 | Matlschweiger | E03F 9/005 134/8 |
| 2004/0065444 | A1 * | 4/2004 | Smith | E21B 47/135 166/381 |
| 2007/0078301 | A1 * | 4/2007 | Kura | A61B 1/00133 600/106 |
| 2009/0031514 | A1 | 2/2009 | Good | |
| 2011/0083701 | A1 * | 4/2011 | Esmacher | B08B 9/00 134/22.11 |
| 2012/0110779 | A1 * | 5/2012 | Jacobson | A46B 13/001 15/387 |
| 2013/0081654 | A1 * | 4/2013 | Harvell | F01D 25/002 134/8 |
| 2015/0021018 | A1 * | 1/2015 | Tunget | E21B 41/0035 166/250.01 |
| 2015/0043311 | A1 * | 2/2015 | Agostini | G08C 17/02 367/197 |

* cited by examiner

CLEANING CHANNELS

CROSS REFERENCE TO RELATED APPLICATIONS

This application claims priority from and the benefit of U.S. Provisional Application Ser. No. 61/991,170, entitled "SYSTEM AND METHOD FOR CLEANING CHANNELS OF A CONNECTOR OF A HYDROCARBON EXTRACTION SYSTEM," filed May 9, 2014 and International Application PCT/US2015/029901, entitled "CLEANING CHANNELS" filed Aug. 5, 2015, which is hereby incorporated by reference in its entirety for all purposes.

BACKGROUND

Components of hydrocarbon extraction systems may be located in onshore, offshore, subsea, or subterranean environments. Hydrocarbon extraction systems can convey various fluids between components via tubular members. The conveyed fluids may be pressurized relative to the external environment of the components or other tubular members. A connector facilitates coupling a tubular member to a component or another tubular member. The connector may be hydraulically actuated to engage and disengage the connector with the tubular member or the component. Hydraulic fluid typically flows through channels of the connector to control the operation of the connector. However, deposits from the environment, the hydraulic fluid, or the production fluid may accumulate within the channels during utilization of the connector. Accumulated deposits may affect the quality of the coupling between the tubular member and the component. Moreover, reassembly and qualification of the connectors after destructive disassembly via adding channel access ports to access and remove the deposits may cause delays to reutilization of the connector.

BRIEF DESCRIPTION

Certain embodiments commensurate in scope with the originally claimed subject matter are summarized below. These embodiments are not intended to limit the scope of the disclosed subject matter, but rather these embodiments are intended only to provide a brief summary of possible forms of the disclosed subject matter. Indeed, the disclosed subject matter may encompass a variety of forms that may be similar to or different from the embodiments set forth below.

In a first embodiment, a method includes inserting a flexible cable into a cleaning region of a channel of a component via a cleaning port, rotating the flexible cable about an axis within the channel to interact a tip with deposits disposed within the cleaning region of the channel, moving the flexible cable within the cleaning region of the channel along a length of the channel, and removing portions of the deposits from the cleaning region of the channel via a second port. The flexible cable includes the axis and the tip. A diameter of the tip is different than a diameter of the flexible cable. The tip is configured to loosen the portions of the deposits.

In a second embodiment, a method includes performing a cleaning operation within a cleaning region of a channel of a connector of a hydrocarbon extraction system and removing portions of deposits from the cleaning region via a second port. The cleaning operation includes rotating a flexible cable about a cable axis within the channel to interact a tip of the flexible cable with deposits disposed within the cleaning region of the channel. The tip is configured to loosen the portions of the deposits. The cleaning operation also includes moving the flexible cable within the cleaning region of the channel along a length of the channel while rotating the flexible cable about the cable axis. The flexible cable extends into the cleaning region of the channel via a cleaning port at an upstream end of the cleaning region of the channel. Removing the portions of the deposits includes inducing a fluid flow from the upstream end of the cleaning region of the channel to a downstream end of the cleaning region of the channel.

In a third embodiment, a system includes a flexible cable, a vacuum conduit, and a pressurized fluid conduit. The flexible cable includes a base, a tip, and a body extending a body length along a cable axis from the base to the tip. The tip has a tip diameter and the body has a cable diameter. The flexible cable is configured to be inserted through a cleaning port of a channel and to rotate about the cable axis within a cleaning region of the channel. Rotation of the flexible cable is configured to interact the flexible cable with deposits disposed within the cleaning region of the channel to loosen portions of the deposits. The cable diameter is less than the tip diameter, and the tip diameter is between 20 to 150 percent of a channel diameter of the channel. The vacuum conduit is configured to provide a low pressure region to one or more ports of the channel downstream of the cleaning port. The pressurized fluid conduit is configured to provide a pressurized fluid to one or more ports of the channel upstream of the cleaning port.

BRIEF DESCRIPTION OF THE DRAWINGS

These and other features, aspects, and advantages of the present disclosed subject matter will become better understood when the following detailed description is read with reference to the accompanying drawings in which like characters represent like parts throughout the drawings, wherein.

DETAILED DESCRIPTION

One or more specific embodiments of the presently disclosed subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the disclosed subject matter, the articles "a," "an," "the," and "said" are intended to mean that there are one or more of the elements. The terms "comprising," "including," and "having" are intended to be inclusive and mean that there may be additional elements other than the listed elements.

The subject matter disclosed herein generally relates to cleaning channels, and more particularly, to a system and method for cleaning hydraulic channels. A connector of a hydrocarbon extraction system may have one or more hydraulic channels that facilitate actuating of hydraulic component of the connector when the connector is installed. Deposits may accumulate within the one or more hydraulic channels when the connector is in service, and the deposits may be removed periodically during maintenance intervals to increase the efficiency and reliability of the hydraulic systems. Embodiments of systems and methods for cleaning the hydraulic channels of connectors described below can enable the removal of at least a portion of the deposits without destructive disassembly of the connector and/or the addition of access points to the connector to access the channel for deposit removal. The cleaning system can rotate a flexible cable and a tip within each channel, where the flexible cable and the tip can be inserted through an existing port coupled to the channel. The flexible cable and the tip can be swept through cleaning regions of each channel to loosen and remove accumulated deposits. In some embodiments, a fluid flow may be induced through the channel before, during, or after the cleaning operation with the flexible cable and the tip to loosen and remove accumulated deposits. Embodiments of the cleaning system and method may decrease the duration of maintenance intervals, decrease the complexity of the maintenance interval, or decrease the cost of the maintenance interval, or any combination thereof.

Figure 1:
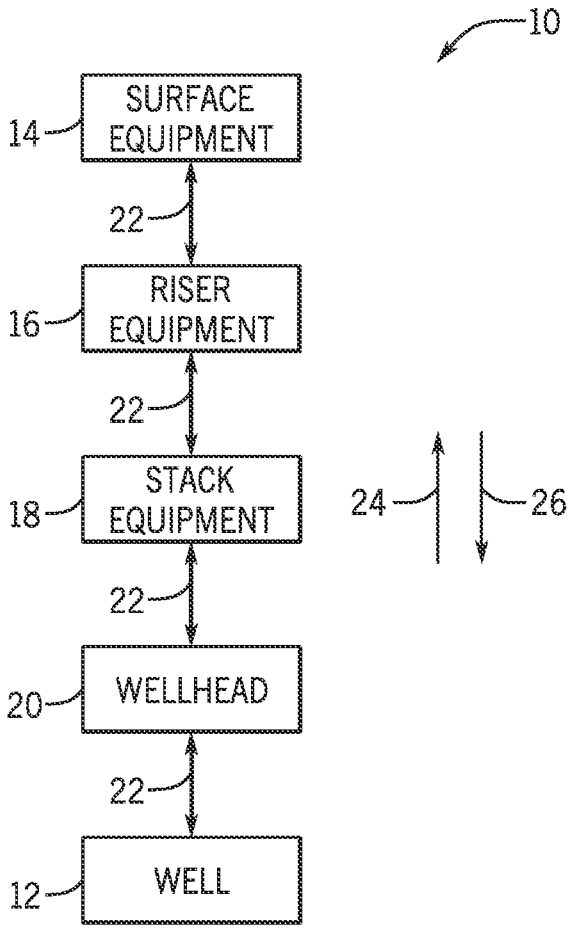
FIG. 1 is a block diagram of an exemplary embodiment of a hydrocarbon extraction system having components coupled via connectors.

Turning now to the present figures, an exemplary hydrocarbon extraction system 10 is illustrated in FIG. 1. The hydrocarbon extraction system 10 facilitates extraction of a hydrocarbon resource, such as oil or natural gas, from a well 12. The hydrocarbon extraction system 10 can include a variety of equipment, including surface equipment 14, riser equipment 16, and stack equipment 18, for extracting the resource from the well 12 via a wellhead 20. The hydrocarbon extraction system 10 may be employed in a variety of drilling or extraction applications, including onshore and offshore, i.e., subsea, drilling applications. For example, in a subsea resource extraction application, the surface equipment 14 can be mounted to a drilling rig above the surface of the water, the stack equipment 18 can be coupled to the wellhead 20 proximate to the sea floor, and the surface equipment 14 can be coupled to the stack equipment 18 via the riser equipment 16. Connectors, illustrated by arrows 22, may facilitate coupling the equipment packages (e.g., surface equipment 14, riser equipment, 16, stack equipment 18, wellhead 20) of the hydrocarbon extraction system 10 to one another. Additionally, or in the alternative, connectors 22 may facilitate coupling of components within an equipment package to one another. Embodiments of the connector 22 may include, but are not limited to, an H-4® subsea connector, available from Vetco Gray of Houston, Tex.

The surface equipment 14 may include a variety of devices and systems, such as pumps, power supplies, cable and hose reels, control units, a diverter, a rotary table, and the like. Similarly, the riser equipment 16 may also include a variety of components, such as riser joints, valves, control units, and sensors, among others. In some embodiments, the riser equipment 16 may include a lower marine riser package (LMRP). The riser equipment 16 can facilitate transmission of the extracted resource to the surface equipment 14 from the stack equipment 18 and the well 12. The stack equipment 18 can also include a number of components, such as one or more blowout preventers (BOPs), a subsea manifold, and/or production trees (e.g., completion or "Christmas" trees) for extracting the desired resource from the wellhead 20 and transmitting it to the surface equipment 14 and the riser equipment 16. The desired resource extracted from the wellhead 20 can be transmitted to the surface equipment 14 generally in an upward direction 24. As utilized herein, a downward direction 26 is hereby defined as opposite the upward direction 24, such that the downward direction 26 is the general direction from the surface equipment 14 to the well 12.

As may be appreciated, some components of the hydrocarbon extraction system 10 may be hydraulically controlled. For example, the one or more connectors 22 may have hydraulically actuated parts that engage and disengage with components of the hydrocarbon extraction system 10. Obstructions (e.g., deposits) within hydraulic channels of components of the hydrocarbon extraction system 10 may be removed during maintenance intervals to increase the efficiency and reliability of the hydraulic systems when installed. Embodiments of systems and methods for cleaning the hydraulic channels of components (e.g., connectors 22) described below may decrease the duration of maintenance intervals, decrease the complexity of the maintenance interval, or decrease the cost of the maintenance interval, or any combination thereof. It may be appreciated that embodiments of the cleaning system and method discussed herein may be utilized with hydraulic, pneumatic, supply, or extraction channels and ports of various components of the hydrocarbon extraction system 10, including, but not limited to, the connectors 22.

Figure 2:
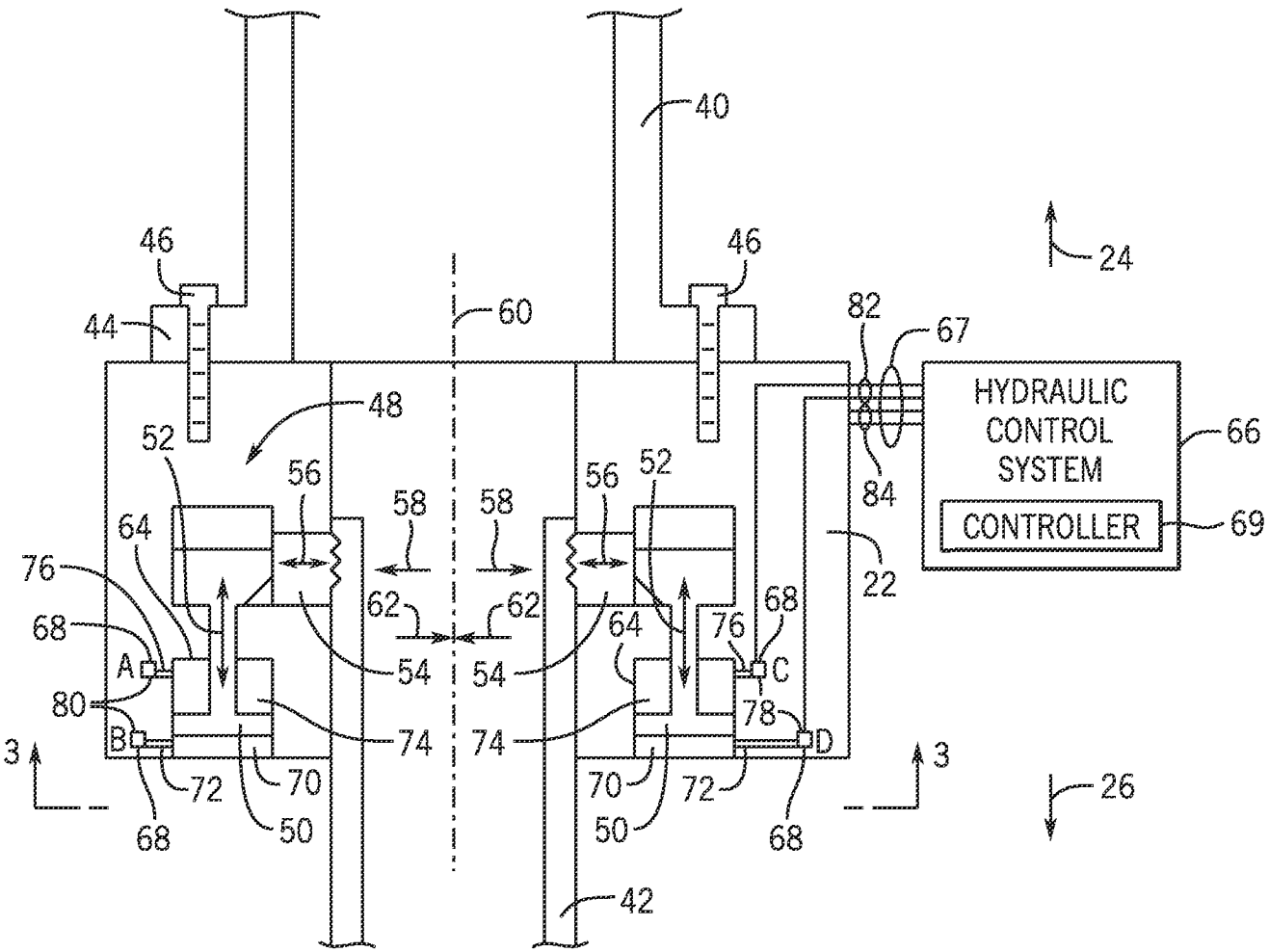
FIG. 2 is an cross-sectional view of an exemplary embodiment of a connector between components of the hydrocarbon extraction system of FIG. 1.

FIG. 2 is an axial cross-sectional view illustrating an exemplary embodiment of the connector 22 arranged between a first component 40 and a second component 42. In some embodiments, the first component 40 may include, but is not limited to, a BOP, a LMRP, a completion tree, a production riser assembly, a single point mooring, or another component above the well 12. The second component 42 may include, but is not limited to, the wellhead 20, a BOP, a subsea manifold, an anchor base, or another component below the surface equipment 14. In some embodiments, the connector 22 can be coupled to the first component 40 via a flange 44 and bolts 46. A hydraulic system 48 of the connector 22 may selectively engage or disengage with the second component 42. For example, movement of one or more pistons 50 in an axial direction 52 may actuate locking dogs 54 in a radial direction 56 relative to the second component 42. For example, movement of the piston 50 in the upward direction 24 may move the locking dogs 54 in a radially outward direction 58 from an axis 60 of the connector 22, thereby decoupling (e.g., unlocking) the connector 22 from second component 42. Conversely, movement of the piston 50 in the downward direction 26 may move the locking dogs 54 in a radially inward direction 62 towards the axis 60, thereby coupling (e.g., locking) the connector 22 with the second component 42. In some embodiments, the locking dogs 54 may form a metal-to-metal seal with the second component 42 when the connector 22 is coupled with the second component 42.

Each piston 50 of the connector 22 can move in an axial direction 52 within a respective cylinder 64 of the connector 22. A hydraulic control system 66 may direct hydraulic fluid through hydraulic conduits 67 and one or more channels 68 to each cylinder 64, thereby hydraulically actuating the piston 50. The hydraulic control system 66 may include, but is not limited to, a pump, a reservoir, and a controller 69. The controller 69 (e.g., a processor-based controller) can be configured to receive instructions to selectively engage or disengage the connector 22 with the second component 42. The hydraulic control system 66 may be separate from or integral with the connector 22. Increasing the hydraulic fluid volume and pressure in a first chamber 70 of the cylinder 64 via a disengagement port 72 relative to the fluid volume and pressure of a second chamber 74 may actuate the piston 50 in the upward direction 24. Increasing the hydraulic fluid volume and pressure in the second chamber 74 of the cylinder 64 via an engagement port 76 relative to the fluid volume and pressure of the first chamber 70 may actuate the piston 50 in the downward direction 26.

The connector 22 may include more than two cylinders 64, such as approximately 3, 4, 5, 6, 7, 8, 9, 10, 11, 12, or more cylinders 64. Additionally, the connector 22 may include 1, 2, 3, 4, 5, or more channels 68 to direct the hydraulic fluid to the cylinders 64. Each channel 68 may extend circumferentially about the connector 22, fluidly coupling with multiple cylinders 64. Some channels 68 may be hydraulically coupled to a subset of the total quantity of cylinders 64. For example, a connector 22 with ten cylinders 64 (e.g., cylinders I, II, III, IV, V, VI, VII, VIII, IX, X) may have two pairs 78, 80 of channels 68 (e.g., A and B, C and D) where each pair of channels 68 is hydraulically coupled to alternating sets of cylinders 64. A first pair 78 of channels 64 (e.g., A and B) may direct hydraulic fluid to a first alternating set of cylinders 64 (e.g., I, III, V, VII, IX), and a second pair 80 of channels 64 (e.g., C and D) may direct hydraulic fluid to a second alternating set of cylinders 64 (e.g., II, IV, VI, VIII, X). The hydraulic control system 66 may supply hydraulic fluid to the first pair 78 via a first set 82 of hydraulic conduits 67, and may supply hydraulic fluid to the second pair 80 via a second set 84 of hydraulic conduits 67.

Figure 3:
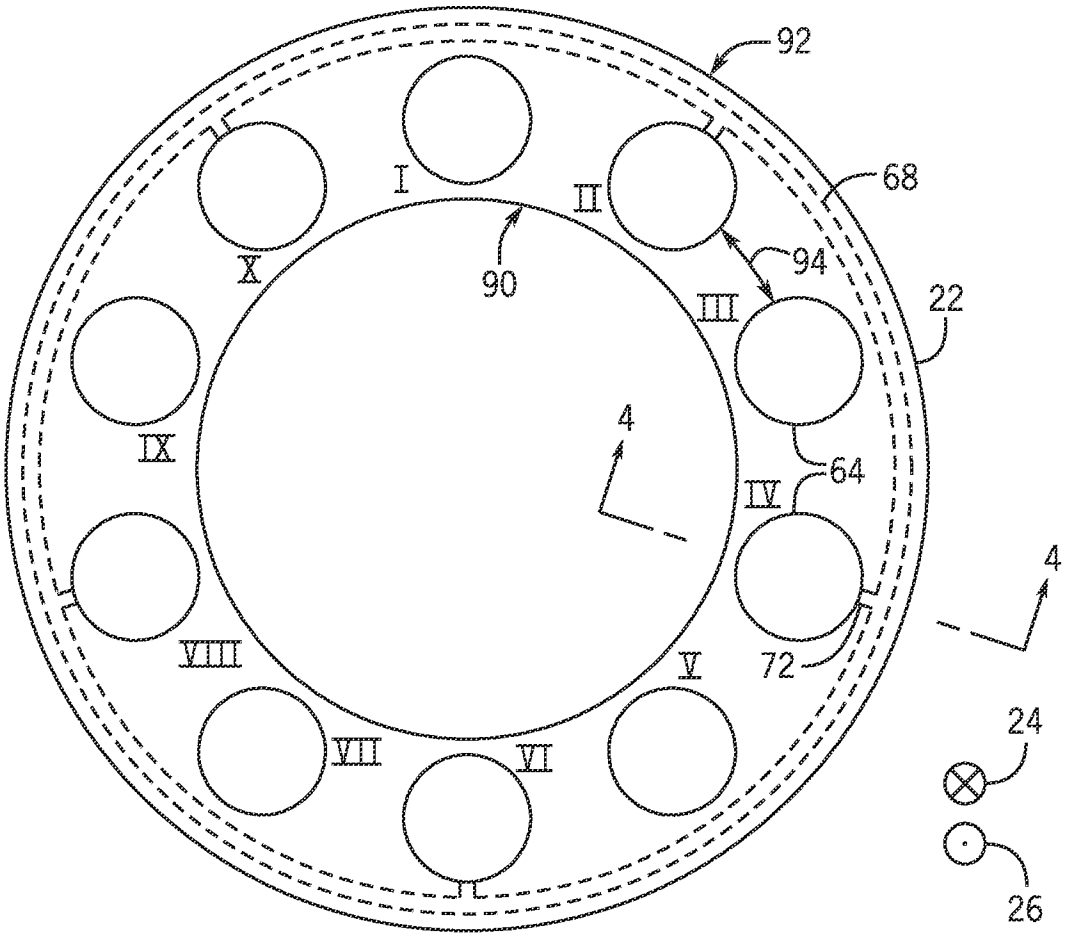
FIG. 3 is a cross-sectional bottom view of the embodiment of the connector shown in FIG. 2, taken from line 3-3.

FIG. 3 illustrates a bottom view of the connector 22 without the pistons 50 within the cylinders 64, taken from line 3-3 of FIG. 2. The cylinders 64 can be circumferentially arranged about the connector 22 between an inner wall 90 and an outer wall 92. In some embodiments, the cylinders 64 can be uniformly spaced a distance 94 from one another about the connector 22. While FIG. 3 illustrates a connector 22 having ten cylinders 64 (e.g., I, II, III, IV, V, VI, VII, VIII, IX, X), other embodiments of the connector 22 may have more or fewer cylinders 64, such as eight or twelve cylinders 64.

Figure 4:
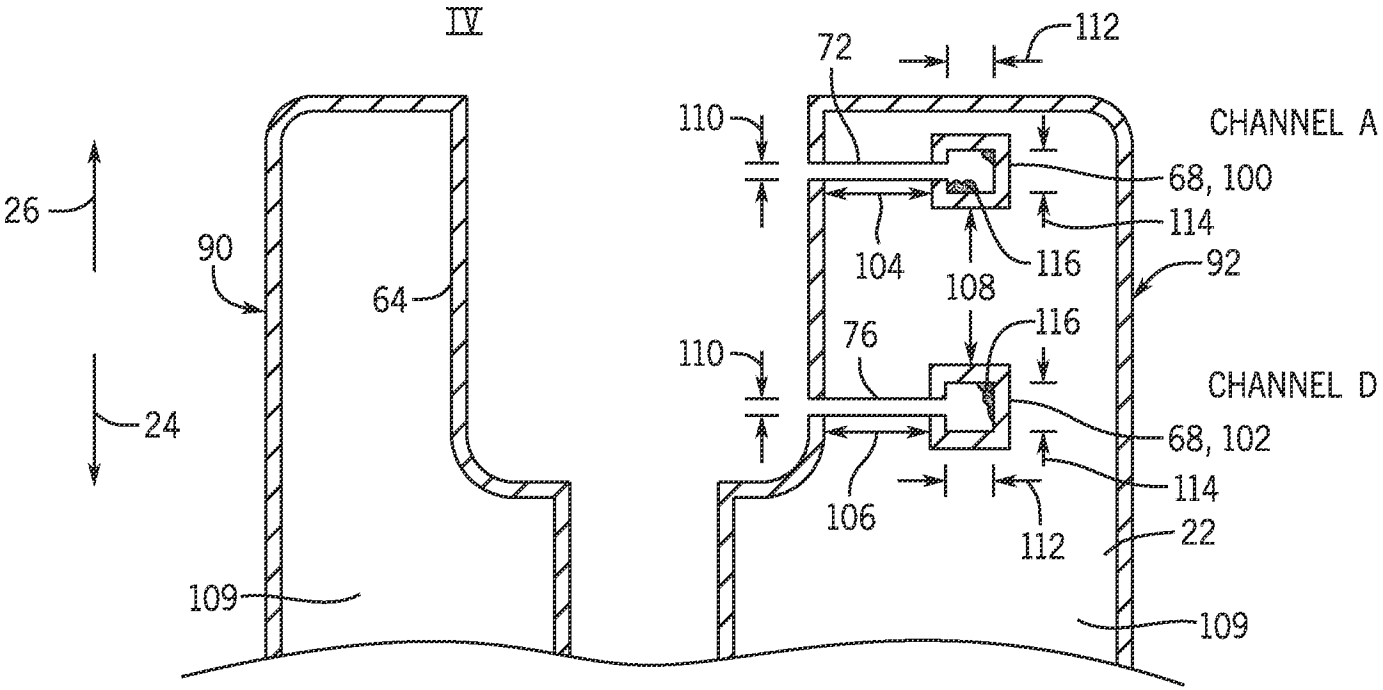
FIG. 4 is an axial cross-sectional view of an embodiment of the cylinder of the connector of FIG. 3, taken from line 4-4.

The channel 68 (e.g., an annular channel, a square channel, a rectangular channel) may supply hydraulic fluid to one or more cylinders 64 to actuate the one or more respective pistons 50. The channel 68 may extend circumferentially about the connector 22 between the cylinders 64 and the outer wall 92. Additionally, or in the alternative, one or more channels 68 (e.g., annular channels, square channels, rectangular channels) may extend circumferentially about the connector 22 between the cylinders 64 and the inner wall 90. As discussed above, each channel 68 may supply hydraulic fluid to a subset of the cylinders 64 of the connector 22. For example, the channel 68 illustrated in FIG. 3 can be connected to the engagement port 76 of alternating cylinders 64 (e.g., II, IV, VI, VIII, X) about the circumference of the connector 22. For clarity, only one channel 68 is illustrated by dashed lines in FIG. 3; however, FIGS. 2 and 4 illustrate other channels 68 axially spaced within the connector 22 above (e.g., in the upward direction 24) or below (e.g., in the downward direction 26) one another. Moreover, while FIG. 3 illustrates only one disengagement port 72 per cylinder 64 coupled to the channel 68, some embodiments of the cylinder 64 may have multiple ports (e.g., disengagement ports 72) coupled to each channel 68.

FIG. 4 illustrates a cross-sectional view of a cylinder 64 (e.g., IV) of the connector 22, taken within line 4-4 of FIG. 3. A first hydraulic channel 100 (e.g., channel A) may supply hydraulic fluid to the cylinder 64 via the disengagement port 72, and a second hydraulic channel 102 may supply hydraulic fluid to the cylinder 64 via the engagement port 76. The first hydraulic channel 100 can be spaced a first distance 104 from the cylinder 64, such that a first length of the disengagement port 72 is approximately equal to the first distance 104. The second hydraulic channel 102 can be spaced a second distance 106 from the cylinder, such that a second length of the engagement port 76 is approximately equal to the second distance 106. Each of the first distance 104 and the second distance 106 may be between approximately 0.3 to 15 cm, 1 to 7.5 cm, or 2 to 5 cm. In some embodiments, the first distance 104 is approximately equal to the second distance 106. The first hydraulic channel 100 may be axially spaced a third distance 108 from the second hydraulic channel 102. The third distance 108 can be between approximately 1 to 20 cm, 2 to 10 cm, or 3 to 5 cm. As may be appreciated, some embodiments of a body 109 of the connector 22 may be substantially solid, thereby providing structural support for the connector 22 to couple components of the hydrocarbon extraction system 10.

An inner diameter 110 of the disengagement and engagement ports 72, 76 may be between approximately 0.1 to 5 cm, 0.5 to 3 cm, or 1.5 to 2.5 cm. A cross-sectional shape of the channels 68 (e.g., first hydraulic channel 100, second hydraulic channel 102) may include, but is not limited to, substantially a square, a rectangle, an ellipse, or a circle. As illustrated in FIG. 4, the ports 72, 76 may extend in a radial direction (e.g., towards the cylinder 64) relative to an axis through the respective channels 68. The channels 68 may have a width 112 between approximately 0.1 to 5 cm, 0.5 to 3 cm, or 1.5 to 2.5 cm. The channels 68 may have a height 114 between approximately 0.1 to 5 cm, 0.5 to 3 cm, or 1.5 to 2.5 cm. For example, the channels 68 may have a square cross-sectional shape with depth 112 and height 114 of approximately 1.9 cm. In another example, the channels 68 may have a rectangular cross-sectional shape with a depth 112 of approximately 1.9 cm, and a height of approximately 1.27 cm.

Deposits 116 may accumulate within one or more of the channels 68 during operation or storage of the connector 22. For example, when the connector 22 is installed between the first component 40 and the second component 42 of the hydrocarbon extraction system 10, deposits 116 may accumulate within the channels 68 and/or the ports 72, 76. The deposits 116 may include, but are not limited to, silt, dust, abraded or eroded material of the connector 22, piston 50, or any combination thereof. Accumulated deposits 116 may affect the efficiency and/or reliability of the hydraulic system 48 of the connector 22. Moreover, accumulated deposits 116 may affect the efficiency of the pumps, valves, and so forth of the hydraulic control system 66. Accordingly, after an installation period (e.g., weeks, months, or years) when the connector 22 is installed within the hydrocarbon extraction system 10, the connector 22 may be removed from the hydrocarbon extraction system 10 for a maintenance interval to remove at least a portion of the deposits 116 that may have accumulated within one or more of the channels 68 during the installation period. During the maintenance interval, one or more technicians may utilize the cleaning system described below to remove at least a portion of the deposits 116 from the channels 68. The cleaning system described herein enables one or more technicians to loosen and remove the deposits 116 from the channels 68 through the existing ports 72, 76 without destructively disassembling the connector or adding additional access points to the channels 68 specifically for the maintenance interval.

Figure 5:
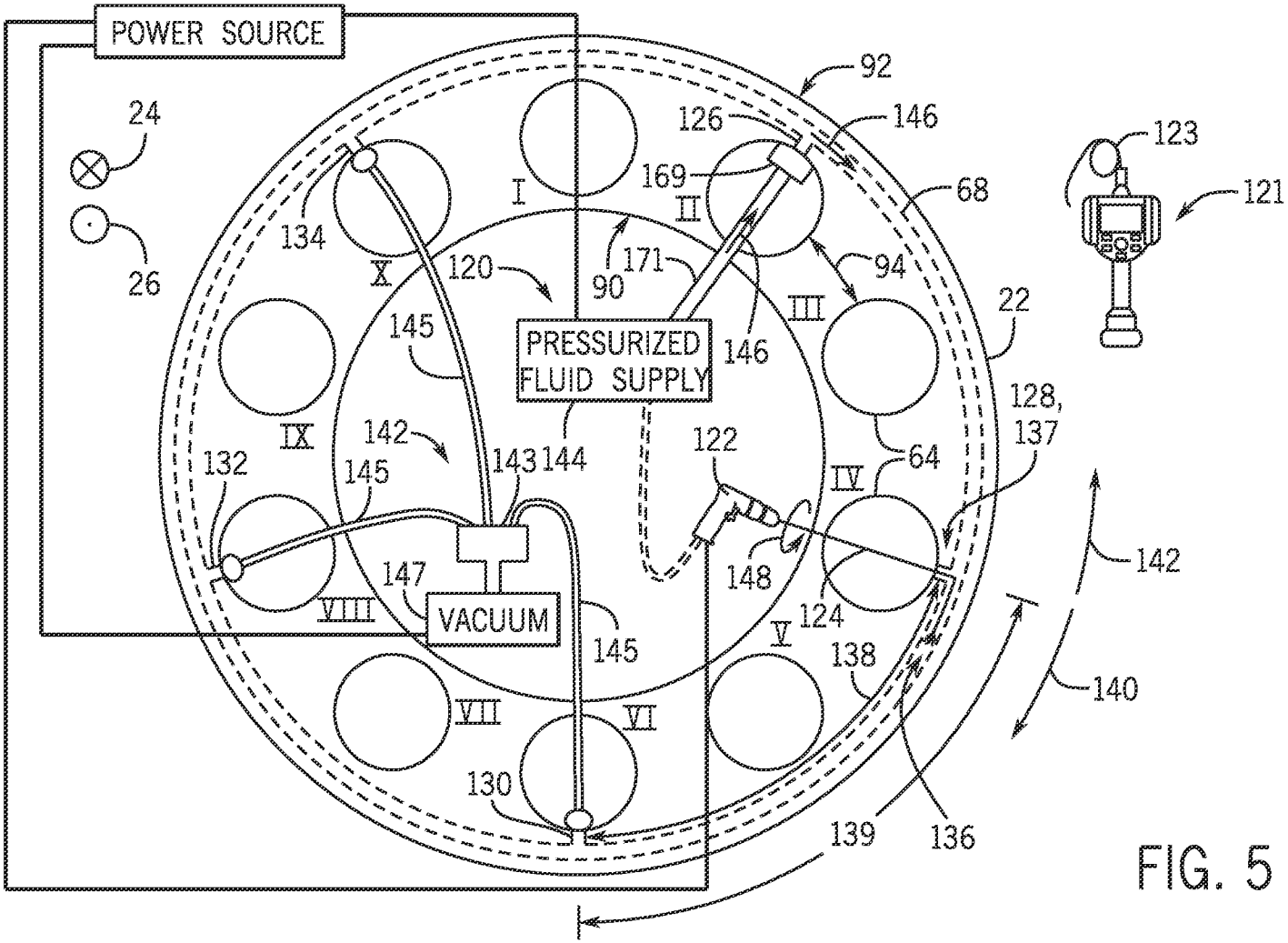
FIG. 5 is a schematic view of an exemplary embodiment of the cleaning system and a channel of the connector.

FIG. 5 illustrates a schematic view of an embodiment of a cleaning system 120 and an inspection system 121 that may be utilized to remove the deposits 116 from the channels 68. The inspection system 121 may include, but is not limited to a borescope 123 that may be inserted through ports (e.g., ports 72, 76) into the channel 68 to determine the characteristics of the deposits 116 within the channel 68. The cleaning system 120 may include a rotary tool 122 (e.g., drill) that rotates a flexible cable 124 within the channel 68 during a cleaning operation. The flexible cable 124 may include, but is not limited to a solid, hollow, twisted, braided, coiled, or woven cable. The material of the flexible cable 124 may include, but is not limited to, steel (e.g., galvanized, stainless), copper, aluminum, or any combination thereof. The material 124 and structure (e.g., twisted, braided, woven) of the flexible cable 124 may be configured to provide sufficient strength to the flexible cable 124 to facilitate pushing the flexible cable 124 through the channel 68 despite the presence of some deposits 116 within the channel 68. Moreover, bending the end of the flexible cable 124 to form the tip 136 may facilitate insertion of the flexible cable 124 despite the presence of some deposits 116. Rotation of the bent tip 136 via the rotary tool 122 may cause the tip 136 to expand, thereby interfacing with deposits 116 in the channel 68. For example, rotation of flexible cable 124 and the tip 136 via the rotary tool 122 within the channel may loosen deposits that would otherwise restrict further insertion of the flexible cable 124 and the tip 136. Stated differently, as the tip 136 rotates, it can strike deposits in the channel 68 to dislodge them.

As discussed above, some channels 68 may be fluidly coupled to alternating cylinders 64 via one or more ports. Accordingly, FIG. 5 illustrates a first port 126 between the channel 68 (e.g., first hydraulic channel 100) and cylinder II, a second port 128 between the channel 68 and cylinder IV, a third port 130 between the channel 68 and cylinder VI, a fourth port 132 between the channel 68 and cylinder VIII, and a fifth port 134 between the channel 68 and cylinder X. During the cleaning operation, the flexible cable 124 can be extended through a cleaning port (e.g., ports 126, 128, 130, 132, 134) of the connector 22 to access a cleaning region 138 of the channel 64. The flexible cable 124 may have a tip 136 configured to interact with deposits 116 within the cleaning region 138 of the channel 68 when the flexible cable 124 and the tip 136 are rotated within the channel 68 during the cleaning operation. As discussed herein, the interaction of the tip 136 and/or the flexible cable 124 with the deposits 116 may include, but is not limited to, scraping, impacting, brushing, sweeping, pushing, pulling, abrading, or any combination thereof. The movement of the cable 124 and/or the tip 136 within the cleaning region 138 of the channel 68 may loosen the deposits 116 for removal. The cleaning region 138 is a region of the channel 68 including the cleaning port 137 that receives the flexible cable 124, and the adjacent downstream port proximate to the tip 136 of the flexible cable 124. That is, the cleaning region 138 may extend from the cleaning port 128, 137 to one or more downstream ports 130, 132, 134. The cleaning region 138 has a length 139 between adjacent ports that is a portion of the circumference of the channel 68. The port that receives the flexible cable 124 is hereby defined as the cleaning port 137. During the maintenance interval, multiple ports 126, 128, 130, 132, and 134 of the channel 68 may be used alternately as the cleaning port 137 to access different cleaning regions 138 of the channel 68. As may be appreciated, the cleaning system 120 may be configured relative to the connector 22 such that each cleaning region 138 may be accessed by at least two ports.

When the flexible cable 124 is inserted in the second port 128 (e.g., cleaning port 137) in a clockwise direction 140 (e.g., to the right) towards the third port 130, the cleaning region 138 extends downstream (e.g., clockwise 140) from the second port 128 to the third port 130. That is, the cleaning region 138 is adjacent the cleaning port 137 in the downstream direction 140. As defined herein, the downstream direction for the flexible cable 124 is the direction (e.g., clockwise 140) that the flexible cable 124 is inserted through the channel 68 relative to the cleaning port 137, and the upstream direction is the direction (e.g., counterclockwise 141) that is opposite the flexible cable 124 and the tip 136 relative to the cleaning port 137. In some embodiments, a vacuum system 142 can be coupled to one or more ports (e.g., third port 130, fourth port 132, fifth port 134) downstream of the cleaning port 137. The vacuum system 142 may provide a low pressure region to the channel 68 relative to the pressure at the cleaning port 137 (e.g., approximately ambient atmospheric pressure), thereby drawing the loosened deposits 116 from the cleaning region 138 of the channel 68 to the one or more respective ports. The vacuum system 142 may include, but is not limited to, a manifold 143, vacuum conduits 145, and a vacuum pump 147 or a suction pump. In some embodiments, the vacuum pump 147 may include, but is not limited to a wet/dry vacuum or a vacuum line of the maintenance facility at which the channels 68 are to be cleaned. One or more of the other ports (e.g., fourth port 132, fifth port 134, first port 126) may be plugged. For example, plugging the fourth port 132 and the fifth port 134 may increase the relative suction of the vacuum system 142 at the third port 130 coupled to the vacuum manifold 143 via the vacuum conduit 145. The vacuum system 142 may be coupled to multiple ports downstream of the cleaning port 137 via the manifold 143 and the vacuum conduits 145, such as the fourth port 132 and/or the fifth port 134. Coupling multiple ports to the vacuum system 142 via the manifold 143 and the vacuum conduits 145 may increase the quantity of deposits 116 removed from the channel 68 via the respective ports coupled to the vacuum system 142. In some embodiments, the vacuum system 142 is coupled to the respective ports at the same time that the flexible cable 124 is moved and rotated within the channel 68, such that the vacuum system 142 may induce a fluid flow through the channel 68 toward the vacuum conduits 145 simultaneous with the rotation of the flexible cable 124. As may be appreciated, the induced fluid flow may act on portions of the deposits 116 loosened by the flexible cable 124, thereby facilitating the removal of the portions of the deposits 116 from the channel 68.

Figure 6:
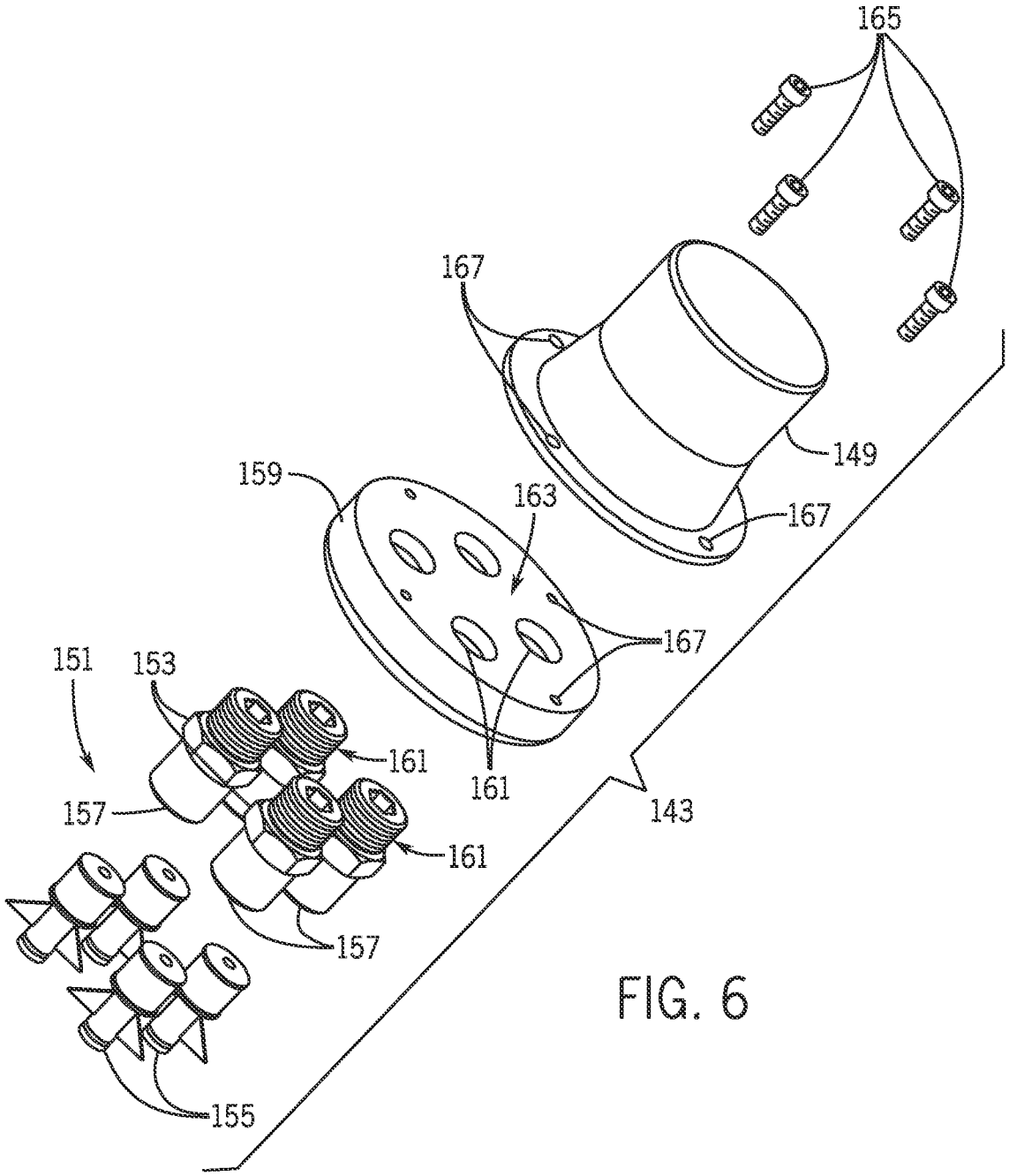
FIG. 6 is an assembly view of an exemplary embodiment of a vacuum manifold of the cleaning system.

FIG. 6 illustrates a perspective assembly view of an embodiment of the manifold 143. In some embodiments, a first end 149 may be configured to couple with the vacuum pump 147, such as a utility hose of a wet/dry vacuum. A second end 151 may be configured to couple with one or more vacuum conduits 145, thereby applying the reduced pressure of the vacuum pump 147 to the channel 68. The second end 151 may have a plurality of vacuum ports 153 to couple with a respective plurality of vacuum conduits 145. The plurality of vacuum ports 153 may include, but is not limited to approximately 2, 3, 4, 5, 6, 7, 8 or more. In some embodiments, one or more plugs 155 may be configured to couple to ends 157 of the vacuum ports 153 not coupled to ports of the connector 22. Moreover, the plugs 155 may be coupled directly to the ports (e.g., 126, 128, 130, 132, 134) of the connector 22 as described above when fewer vacuum conduits 145 are to be coupled to the vacuum system 142.

The vacuum ports 153 of the second end 151 may be coupled to the first end 149 via a manifold plate 159. In some embodiments, the vacuum ports 153 can be coupled to the manifold plate 159 via threaded connections 161, as shown in FIG. 6. An inner face 163 of the manifold plate 159 may be coupled to the first end 149 via fasteners 165 through holes 167. Additionally, or in the alternative, the first end 149 may be integrally formed with the manifold plate 159, bonded (e.g., welded, adhered) with the manifold plate 159, or molded with the manifold plate 159.

Returning to FIG. 5, in some embodiments, a pressurized fluid supply 144 can be coupled to one or more ports (e.g., first port 126) upstream of the cleaning port 137 via a flow connector 169 and a pressurized fluid conduit 171. The pressurized fluid supply 144 may include, but is not limited to, a pressurized tank or reservoir, a compressor, and so forth. The fluid of the pressurized fluid supply 144 may include, but is not limited to air, oxygen, carbon dioxide, nitrogen, steam, solvent, cleaning solution, water, or another fluid. In some embodiments, the fluid of the pressurized fluid supply 144 may be heated or cooled prior to being supplied to the one or more ports upstream of the cleaning port 137. As may be appreciated, a heated fluid may reduce the viscosity of deposits 116 within the channel 68 and/or cause evaporation of moisture within the deposits 116. Additionally, a cooled fluid may increase the viscosity of deposits 116, solidify deposits 116, and/or cause deposits 116 to become more susceptible to breakage upon interaction with the tip 136, thereby increasing the effectiveness of the cleaning system 120 to clean the channel 68.

While the term pressurized air supply 144 can be utilized at various points of the present disclosure, it may be appreciated that some embodiments may utilize other fluids in place of or in addition to air. A pressurized fluid flow 146 from the pressurized fluid supply 144 may flow downstream 140 through the channel 68 towards the cleaning port 137 and the cleaning region 138, thereby facilitating the loosening and removal of the deposits 116 within the channel 68.

In some embodiments, the pressurized air supply 144 is coupled to the respective upstream ports at the same time that the flexible cable 124 is moved and rotated within the channel 68, such that the pressurized air supply 144 may induce a fluid flow through the channel 68 through the cleaning region 138 simultaneous with the rotation of the flexible cable 124. As may be appreciated, the induced fluid flow may act on portions of the deposits 116 loosened by the flexible cable 124, thereby facilitating the removal of the portions of the deposits 116 from the channel 68. Moreover, in some embodiments, the pressurized air supply 144 is coupled to the respective upstream ports and the vacuum system 142 is coupled to the respective downstream ports at the same time that the flexible cable 124 is moved and rotated within the channel 68. Accordingly, the pressurized air supply 144 and the vacuum system 142 may simultaneously induce a fluid flow through the channel 68 through the cleaning region 138 while the flexible cable 124 is moved and rotated within the channel 68, thereby facilitating the removal of the loosened portions of the deposits 116 from the channel 68.

Figure 7:
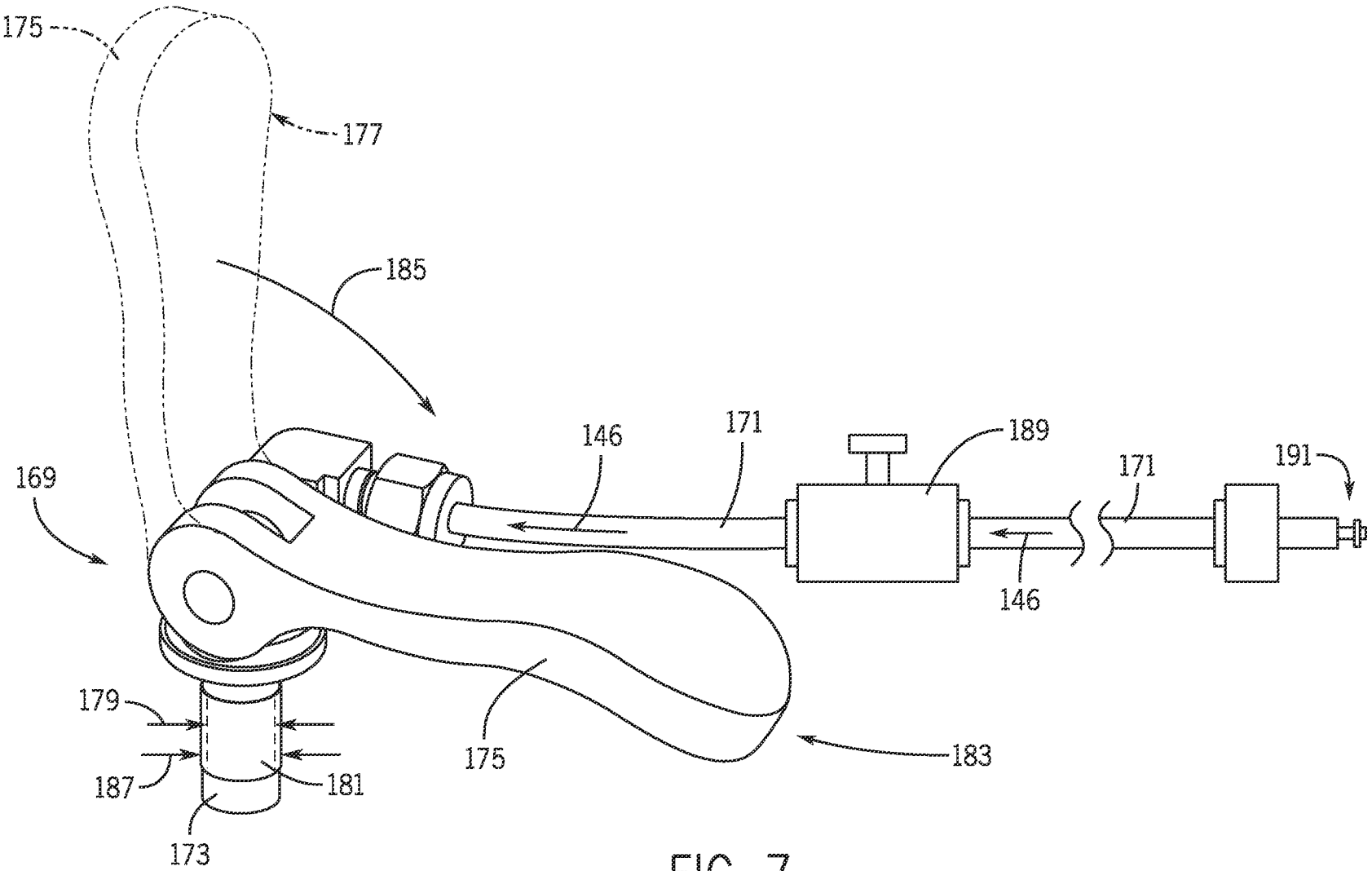
FIG. 7 is a perspective view of an exemplary embodiment of an air injector of the cleaning system.

FIG. 7 illustrates an embodiment of the flow connector 169 and the pressurized fluid conduit 171 that may supply a pressurized fluid (e.g., compressed air) to the channel 68 via one or more ports upstream of the cleaning port 137. A tip 173 of the flow connector 169 may be inserted within the respective port. In some embodiments, the flow connector 169 can be a quick release connector that may be retained within the respective port by actuation of a release lever 175. When the release lever 175 is in a first position shown by the dashed outline 177, a diameter 179 of a portion 181 of the tip 173 is less than the diameter 110 of the port; actuation of the release lever 175 to a second position 183 as shown by the arrow 185 may expand the diameter 187 of the portion 181 of the tip 173 to be greater than or approximately equal to the diameter 110 of the port. As may be appreciated, the portion 181 of the tip 173 may be a flexible material (e.g., elastomer, rubber, plastic) that interfaces and seals with the port 110 to retain the flow connector 169 coupled to the port without additional manual assistance by the technician. That is, actuation of the release lever 175 may engage the tip 173 with the port, thereby forming a seal and maintaining the connection between the flow connector 169 and the port. Additionally, the tip portion 173 and release lever 175 of the flow connector 169 may be configured to enable flow of the pressurized fluid through the tip 173 when the release lever 175 is in the second position 183, and to disable flow of the pressurized fluid through the tip 173 when the release lever 175 is in the first position 177.

The flow connector 169 can receive the pressurized fluid (e.g., compressed air) 146 through the pressurized fluid conduit 171. In some embodiments, a regulator 189 coupled to the pressurized fluid conduit 171 may facilitate manual adjustment of the pressure of the pressurized fluid to the flow connector 169. For example, the regulator 189 may control the pressure of the pressurized air (e.g., air) to be less than approximately 689, 517, 344, or 206 kPa (i.e., approximately 100, 75, 50, or 30 psi). Moreover, the pressurized fluid conduit 171 may be coupled to the pressurized fluid supply 144 (e.g., compressor, pressure vessel) via a fitting 191.

Returning to FIG. 5, the pressurized fluid supply 144 may be coupled to one or more ports upstream 141 of the cleaning port 137 when the vacuum system 142 is not coupled to one or more ports downstream 140 of the cleaning port 137. In some embodiments, the pressurized air supply 144 may be coupled to one or more ports upstream 141 of the cleaning port 137 while the vacuum system 142 is simultaneously coupled to one or more ports downstream 140 of the cleaning port 137. Furthermore, in some embodiments, the vacuum system 142 and the pressurized air supply 144 may be integrated such that the vacuum system 142 is an intake for the pressurized air supply 144. Accordingly, the pressurized air supply 144 may draw at least a portion of the airflow through the vacuum system 142, filter and compress the airflow 146, and direct the pressurized airflow 146 downstream 140 through the channel 68.

In some embodiments, the rotary tool 122 can be driven pneumatically by a pressurized airflow from the pressurized air supply 144. Additionally, or in the alternative, the rotary tool 122 (e.g., drill) can be driven by another power source including, but not limited to, a hydraulic or electrical source (e.g., outlet, battery, generator). During the cleaning operation, the rotary tool 122 may rotate the flexible cable 124 about a cable axis, as shown by an arrow 148. In some embodiments, the rotary tool 122 may rotate the flexible cable 124 at speeds greater than approximately 50, 100, 200, 500, 1000, 2500, 5000 RPM, or more. Additionally, or in the alternative, the rotary tool 122 may rotate the flexible cable 124 in pulses, such as for approximately 1, 3, 5, 10, or more seconds with a pause between subsequent pulses. The pause may be between approximately 0.1 to 2 or more seconds. In some embodiments, the rotary tool 122 may adjust (e.g., increase, decrease) the rotational speed of the flexible cable 124 during the cleaning operation.

The rotary tool 122 may rotate the flexible cable 124 and the tip 136 within the cleaning region 138 of the channel 68 during the cleaning operation to loosen deposits from the channel 68. In some embodiments, the flexible cable 124 and/or the tip 136 may scrape (e.g., abrade) walls of the channel 68 to loosen the deposits 116. Additionally, or in the alternative, the flexible cable 124 and/or the tip 136 may impact the deposits 116 to loosen portions of the deposits 116. The flexible cable 124 and the tip 136 may be moved upstream 141 or downstream 140 along the length 139 of the cleaning region 138 during the cleaning operation to access different areas of the cleaning region 138. That is, the flexible cable 124 and the tip 136 may push or pull portions of the deposits 116 along the channel 68, such as towards a downstream port to be removed via the vacuum system 142. In some embodiments, the flexible cable 124 and the tip 136 may rotate within the channel 68 while moving upstream 141 and/or downstream 140 within the cleaning region 138. For example, during a cleaning operation the tip 136 may be fed downstream 140 through the channel 68 from the cleaning port 137 (e.g., second port 128) to the port (e.g., third port 130) coupled to the vacuum system 142 while rotating within the channel 68. In some embodiments, the flexible cable 124 and the tip 136 can be swept through the cleaning region 138 of the channel 68 multiple times (e.g., 2, 3, 4, 5, 6, 7, 8, 9, 10 times or more) during a cleaning operation before changing the feed direction (e.g., clockwise, counterclockwise) of the flexible cable 124 through the channel 68 or changing which port is the cleaning port 137.

Figure 8:
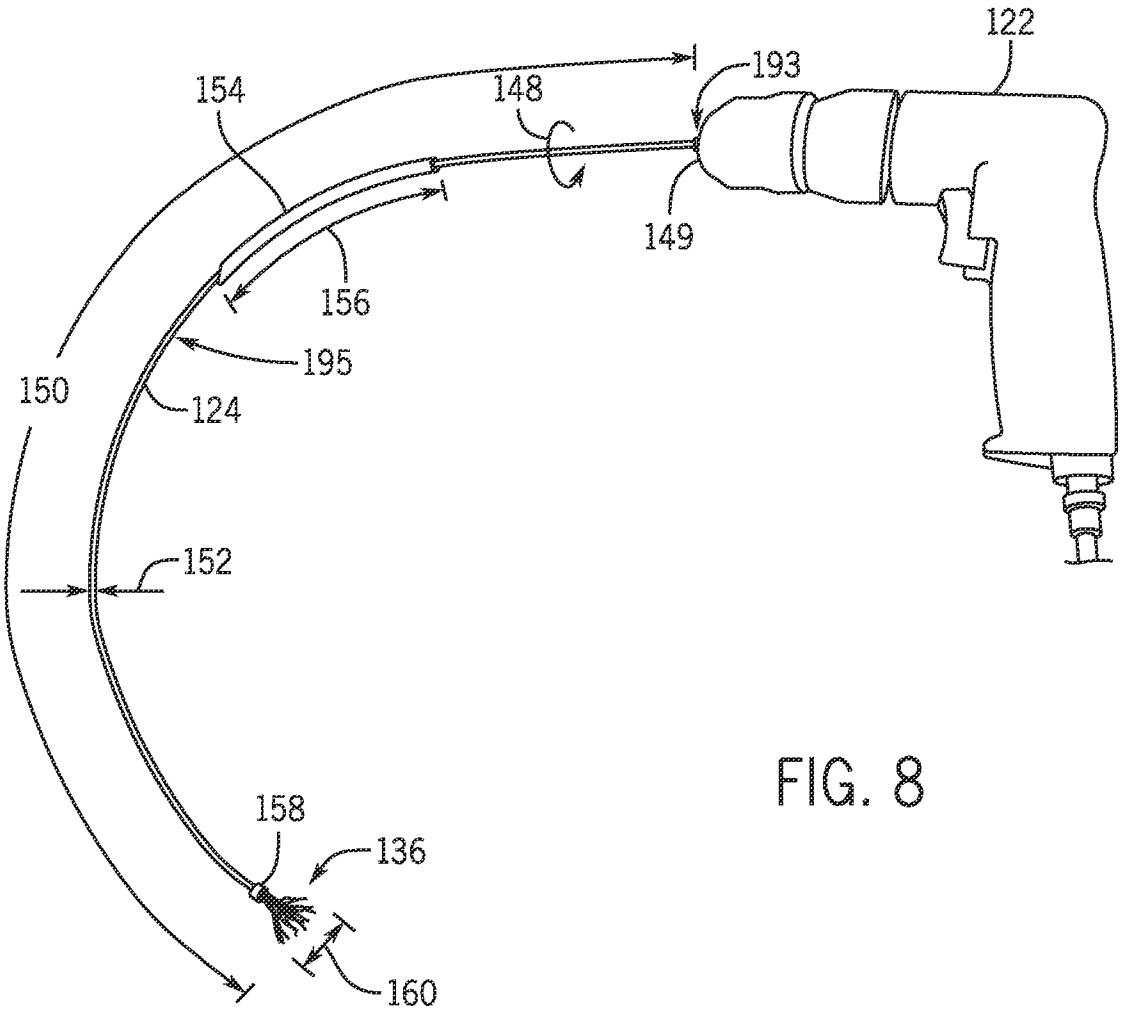
FIG. 8 illustrates an exemplary embodiment of a rotary tool, a flexible cable, and a tip of the cleaning system.

FIG. 8 illustrates an embodiment of the rotary tool 122 and flexible cable 124 of the cleaning system 120. A base 193 of the flexible cable 124 may be removably coupled to the rotary tool 122 via a chuck 148. The flexible cable 124 has a cable length 150 that is between approximately half the length 139 of the cleaning region 138 and the circumference of the channel 68, although other lengths are possible. The cable length 150 extends along a body 195 of the flexible cable 124 from the base 193 to the top 136. Accordingly, the cable length 150 of the flexible cable 124 may enable the cleaning system 120 to clean substantially the entire channel 68 during the maintenance interval via insertion through one or more cleaning ports 137. A diameter 152 of the flexible cable 124 is typically less than the port diameter 110, thereby enabling the flexible cable 124 to be inserted through each port. The diameter 152 of the flexible cable 124 may be between approximately 0.1 to 5 cm, 0.5 to 3 cm, or 1.5 to 2.5 cm, although other diameters are possible. In some embodiments, the diameter 152 of the flexible cable is less than approximately ½, ¼, ⅛, or 1/16 of the port diameter 110. The diameter 152 of the flexible cable 124 may be based at least in part on the tip 136 coupled to the flexible cable 124. For example, a smaller diameter of the flexible cable 124 may facilitate higher rotational speeds used for removal of deposits 116 via scraping or brushing interactions, whereas a larger diameter of the flexible cable 124 may facilitate removal of deposits 116 via pushing or pulling interactions with lower rotational speeds or even no rotation. The flexible cable 124 may be a solid, twisted, braided, coiled, or woven cable. In some embodiments, the flexible cable 124 has multiple axially coupled sections. For example, clamps 158 or rings coupling sections of flexible cable 124 may provide nodes that enable different types of movement of the flexible cable 124 and/or the tip 136 relative to single sections of flexible cable 124. The material of the flexible cable 124 may include, but is not limited to, steel (e.g., galvanized, stainless), copper, aluminum, or any combination thereof.

A portion of the flexible cable 124 may extend through a sleeve 154. When the flexible cable 124 is inserted in the cleaning port 137, the sleeve 154 may be radially disposed between the flexible cable 124 and the cleaning port 137 relative to the cable axis. A sleeve length 156 may be approximately equal to or greater than a port length (e.g., first length 104, second length 106) of the cleaning port 137. That is, the sleeve length 156 may be greater than approximately 0.3, 2, 5, 7.5 or 15 cm or more. The sleeve 154 may reduce or eliminate wear of the cleaning port 137 during a cleaning operation when the flexible cable 124 rotates within the cleaning port 137 and the channel 68. Materials of the sleeve 154 may include, but are not limited to, metal, plastic, ceramic, or any combination thereof. The flexible cable 124 may rotate within the sleeve 154 during rotation of the flexible cable 124. Moreover, the flexible cable 124 may move axially relative to the sleeve 154, such as during insertion and removal of the flexible cable 124 from the channel 68.

In some embodiments, the tip 136 can be integral with the flexible cable 124. That is, the tip 136 may be unitary (e.g., one-piece) with the flexible cable 124. For example, the tip 136 may be a spread (e.g., frayed, fanned, dispersed, separated) portion of a braided or woven cable. A clamp 158 or ring may block the remainder of the flexible cable 124 upstream from the tip 136 from becoming unwound or frayed. In some embodiments, the tip 136 may be a separate component from the flexible cable 124, and the tip 136 may be coupled to the flexible cable 124 via the clamp 158 or ring. A diameter 160 of the tip 136 may be greater than the cable diameter 152. The diameter 160 of the tip 136 may be between approximately 20 to 150, 30 to 100, or 50 to 75 percent of the port diameter 110 of the cleaning port 137. That is, the diameter 160 of the tip 136 when outside the channel 68 may greater than the diameter (e.g., depth 112, height 114) of the channel 68 such that portions of the tip 136 can be biased against the surface of the channel 68 when the tip 136 is disposed within the channel 68. In some embodiments, multiple tips 136 may be coupled to the flexible cable 124.

Figure 9:
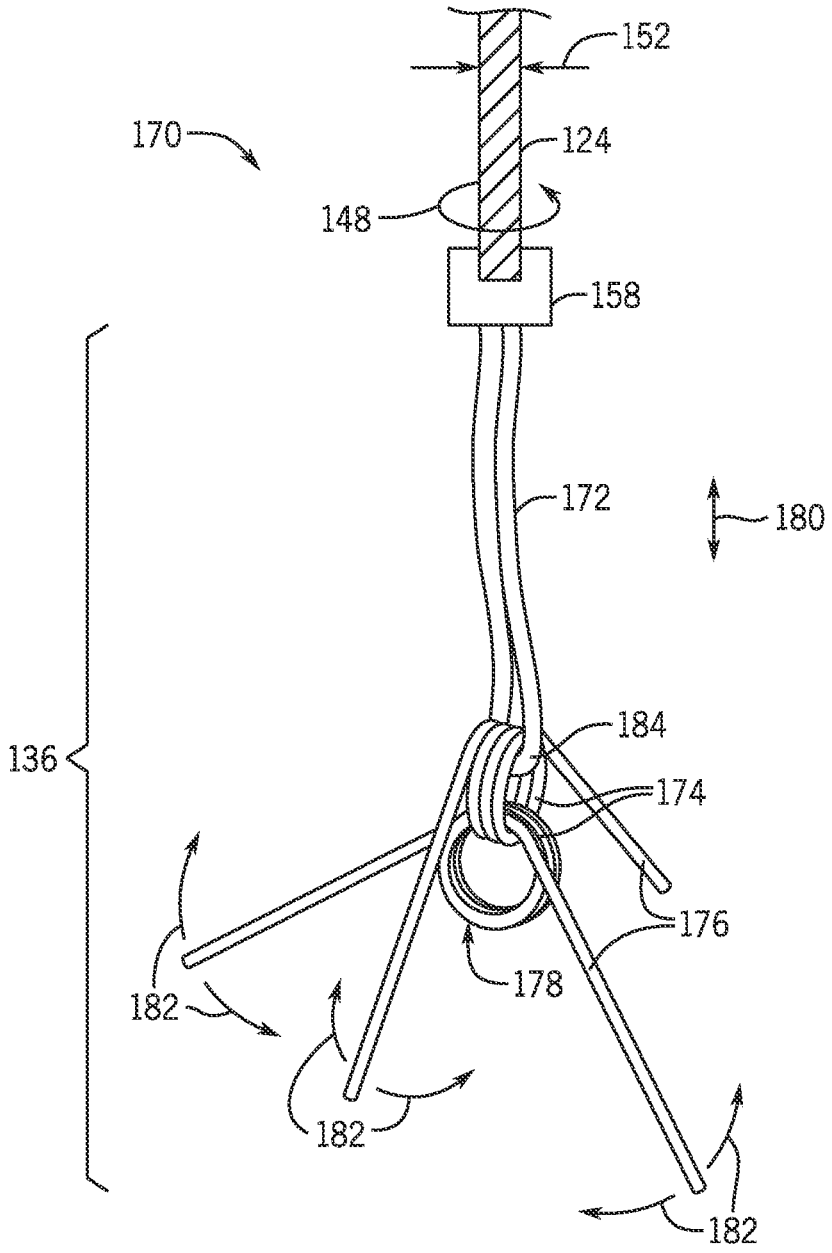
FIG. 9 illustrates an exemplary embodiment of the tip of the cleaning system.

FIGS. 9-12 illustrate exemplary embodiments of the tip 136 that may be integral with or coupled to the flexible cable 124. FIG. 9 illustrates a first cleaning tip 170 with a lanyard 172 securing scraping elements 174 to the flexible cable 124. The scraping elements 174 may have one or more prongs 176 that flail or thrash about the channel 68 when the flexible cable 124 and the first cleaning tip 170 rotate in direction 148 during the cleaning operation. For example, the scraping elements 174 illustrated in FIG. 9 are V-shaped. The lanyard 172 may be looped through hoops 178 (e.g., coil spring portions) of the scraping elements 174, enabling the scraping elements 174 to move in an axial direction 180 along the lanyard 172. Additionally, or in the alternative, the scraping elements 174 may pivot about a tethered point 184 of the lanyard 172, as illustrated by arrows 182. The hoops 178 of the scraping elements 174 may be biased to facilitate flexible movement within the channel 68. The movement and/or pivoting of the scraping elements 174 relative to the lanyard 172 during a cleaning operation (e.g., while rotating within the channel 68) may increase the flexibility of the first cleaning tip 170. The flexibility of the first cleaning tip 170 may enable the prongs 176 to scrape and/or to impact deposits in corners of the channel 68, thereby facilitating the removal from the channel 68. Once the prongs 176 are arranged in the corners of the channel 68, the tip 136 may be moved in the axial direction 180 relative to the channel 68 to push or pull along the corners of the channel 68 so that portions of deposits 116 in the corners may be dislodged by the prongs 176. Moreover, as discussed above, the diameter 152 of the flexible cable 124 coupled to the first cleaning tip 170 may be greater than the diameter 152 of the flexible cable coupled to the tip 136 illustrated in FIG. 8. In some embodiments, the lanyard 172 can be one or more strands of the flexible cable 124. The material of the lanyard 172 may include, but is not limited to, steel (e.g., galvanized), copper, steel, aluminum, or plastic. The materials of the scraping elements 174 may include, but are not limited to, steel (e.g., galvanized), copper, aluminum, ceramic, or any combination thereof.

Figure 10:
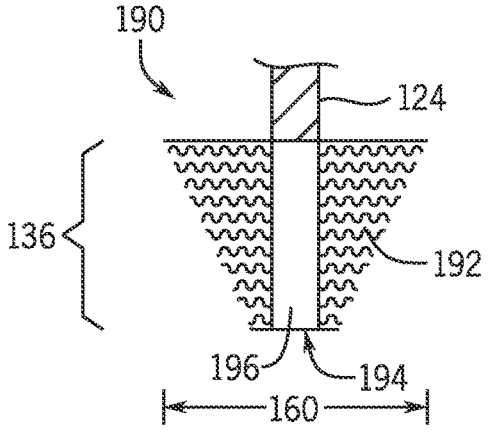
FIG. 10 illustrates an exemplary embodiment of the tip of the cleaning system.
Figure 11:
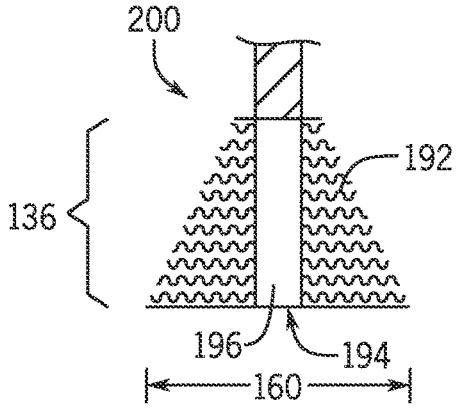
FIG. 11 illustrates an exemplary embodiment of the tip of the cleaning system.

FIG. 10 illustrates an embodiment of a second cleaning tip 190 that may be integral with or coupled to the flexible cable 124. The second cleaning tip 190 can be a tapered brush with radially protruding bristles 192 that taper towards an end 194 of the second cleaning tip 190. In some embodiments, the radially protruding bristles 192 can be coupled to a cap 196 mounted to the flexible cable 124. In some embodiments, the radially protruding bristles 192 extend through the flexible cable 124. The material of the radially protruding bristles 192 may include, but is not limited to steel (e.g., galvanized), copper, aluminum, ceramic, or any combination thereof. FIG. 11 illustrates an embodiment of a third cleaning tip 200 that may be integral with or coupled to the flexible cable 124. The third cleaning tip 200 can be a tapered brush with radially protruding radially protruding bristles 192 that are broadest at the end 194 of the third cleaning tip 200. The radially protruding bristles 192 of the second and third cleaning tips 190, 200 may be disposed circumferentially about approximately 25, 50, 75, or 100 percent of the circumference of the flexible cable 124. In some embodiments, the radially protruding bristles 192 can be disposed in one or more opposing pairs about the flexible cable 124. As discussed above, the diameter 160 of the tip 136 may be between approximately 20 to 150, 30 to 100, or 50 to 75 percent of the depth 112 and height 114 of the channel 68, although other diameters are possible. For example, even diameters that are larger than the ports through which the channel 68 is accessed and/or the channel 68 itself (e.g., the bristles 192 can be compressed by the channel 68 while in use).

Figure 12:
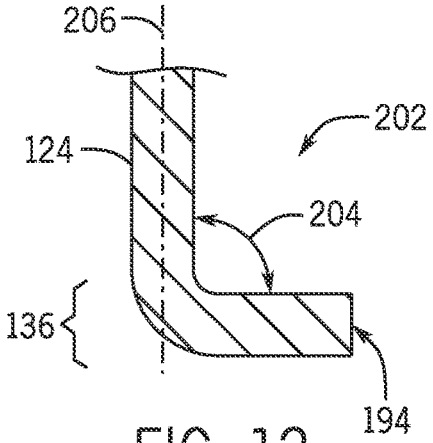
FIG. 12 illustrates an exemplary embodiment of the tip of the cleaning system.

FIG. 12 illustrates an embodiment of a fourth cleaning tip 202 where the tip 136 extends at an angle 204 from an axis 206 of the flexible cable 124. That is, the end 194 of the flexible cable 124 can be bent about a point 208 of the flexible cable 124, thereby forming the tip 136 into an L-shape. Some embodiments of the fourth cleaning tip 202 may include, but are not limited to a T-shape, a C-shape, a V-shape, or a J-shape. In some embodiments, the L-shape may axially push or pull deposits 116 along the channel 68, and the diameter 152 of the flexible cable 124 coupled to the fourth cleaning tip 202 may be greater than the diameter 152 of flexible cables 124 coupled to the first, second, and third cleaning tips 176, 190, 200. It is believed that the L-shape of the fourth cleaning tip 202 may facilitate greater scraping and/or impact forces on deposits 116 than other cleaning tips alone.

The fourth cleaning tip 202 may be combined with the frayed tip 136 of FIG. 8, the first cleaning tip 170 of FIG. 9, the second cleaning tip 190 of FIG. 10, or the third cleaning tip 200 of FIG. 11, or any combination thereof. While FIGS. 8-12 illustrate specific embodiments of tips 136 integral with or coupled to the flexible cable 124, it may be appreciated that tips 136 may have various shapes. Some tips 136 (e.g., first cleaning tip 170) may loosen deposits in corners of the channel 68 better than other tips 136. Furthermore, the second tip 190 may best loosen deposits when the flexible cable 124 is moved downstream 140 during the cleaning operation, and the third cleaning tip 200 may best loosen deposits when the flexible cable 124 is moved upstream 141 during the cleaning operation. Accordingly, the technician may select a tip 136 based at least in part on the thickness of the deposits, the location of the deposits within the cross-section (e.g., from 0 to 360° about the channel 68 from a reference plane), the shape of the channel 68, or movement of the flexible cable 124 within the channel 68, or any combination thereof.

Figure 13:
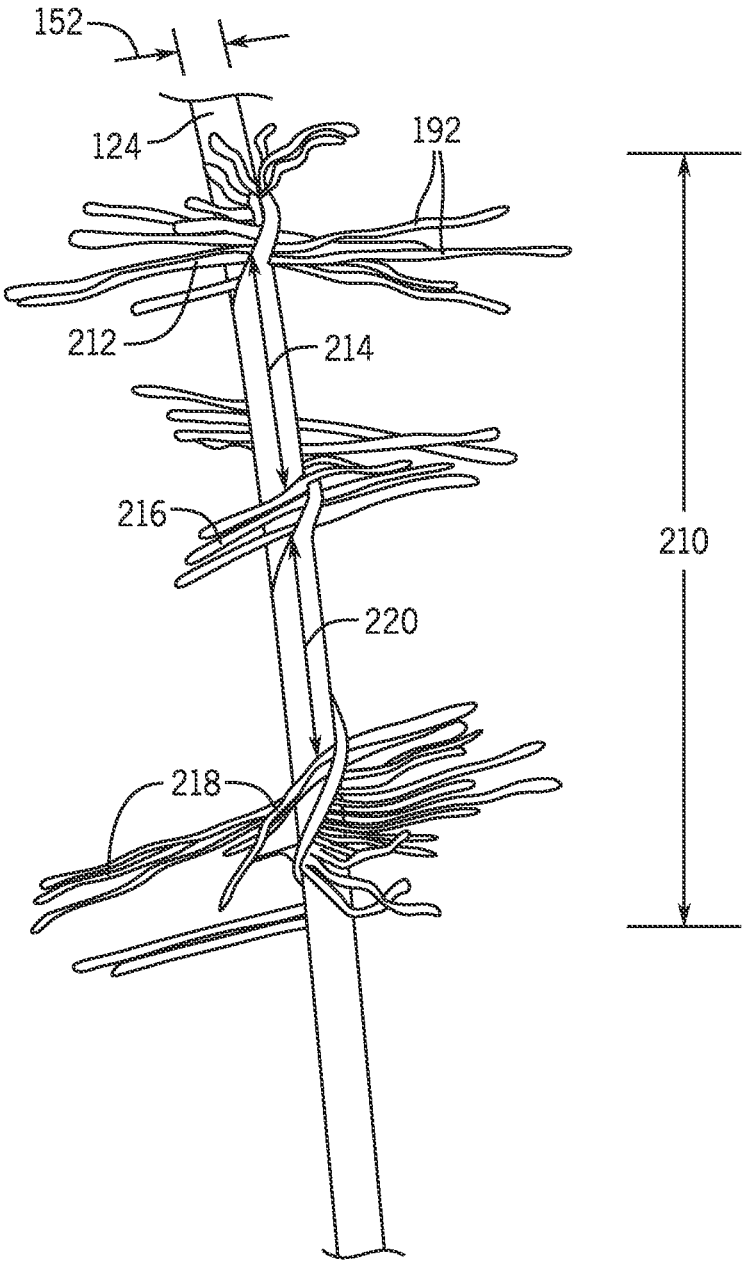
FIG. 13 illustrates an exemplary embodiment of a portion of the flexible cable of the cleaning system.

FIG. 13 illustrates an embodiment of the flexible cable 124 with cleaning elements (e.g., bristles 192) disposed along a cleaning length 210 of the flexible cable. The bristles 192 extend from the flexible cable 124 in one or more radial directions, and the bristles 192 may extend between approximately 2 to 15, 3 to 10, or 5 to 8 times the cable diameter 152. The bristles 192 may be mounted to and/or interwoven with the flexible cable 124. The flexible cable 124 may include 1, 2, 3, 4, 5, 6, 7, 8, 9, 10, or more sets of bristles 192 spaced at uniform or varying distances along the cleaning length 210. For example, a first set 212 of the bristles 192 can be spaced a first distance 214 from a second set 216 of the bristles 192. A third set 218 of the bristles 192 can be spaced a second distance 220 from the second set 216 of the bristles 192. One or more of the quantity of bristle sets, the spacing (e.g., first and second distances 214, 220) between bristle sets, the length of the bristles 192, or the cleaning length 210 may be controlled to adjust the cleaning effect of the bristles 192 within the channel 68.

Some embodiments of the cleaning system 120 discussed above may be arranged together in a kit to be utilized by one or more technicians to remove deposits from hydraulic channels, such as the hydraulic channels of a connector 22 discussed above. Embodiments of the kit may include components of the cleaning system 120 described above, spare parts for the cleaning system 120, and various tools to assemble and couple the components of the cleaning system 120. A first embodiment of the kit may include, but is not limited to, the items and quantities of the items listed below in Table 1:

TABLE 1

| Qty | Item |
|---|---|
| 4 | 0.48 cm × 152.4 cm (3/16 inch × 5 ft) flexible cable (124) |
| 2 | 0.64 cm OD × 30.5 cm (¼ inch × 1 ft) sleeve (156) |
| 4 | first cleaning tip (170) |
| 1 | rotary tool (122) |
| 1 | manifold (143) |
| 4 | 1.27 cm × 70 cm (½ inch × 5 ft) vacuum conduits (147) |
| 1 | 1.27 cm × 152.4 cm (½ inch × 5 ft) spare vacuum conduit (147) |
| 2 | 0.64 cm × 152.4 cm (¼ inch × 5 ft) pressurized fluid conduit (171) |
| 1 | quick release flow connector (169) |
| 1 | Regulator (189) |

A second embodiment of the kit may include the items listed in Table 1, as well as one or more of the following items: a Chicago fitting, a ¼ inch Tripod air manifold, spare swagelok inserts, spare air injector gaskets, a ¼ inch Schrader male adapter, a ¼ inch Schrader female adapter, a ¼ inch Industrial male adapter, a ⅜ inch Industrial male adapter, a ½ inch Schrader female adapter, a ¼ inch ARO male adapter, a ⅜ inch ARO female adapter, a ⅜ inch high flow quick coupling female adapter; a ⅜ inch True-Flate male adapter, a ⅜ inch to ¼ inch NPT thread adapter bushing, a ¼ inch to ¼ inch NPT thread adapter coupling, a ⅜ inch to ⅜ inch NPT thread adapter coupling, a ¼ inch to ¼ inch NPT thread adapter nipple, a ⅜ inch to ⅜ inch NPT thread adapter nipple, tool oil, a vise-grip set, a scribing tool, electrical tape, a Pex tubing cutter, an adjustable wrench, and PTFE tape.

Figure 14:
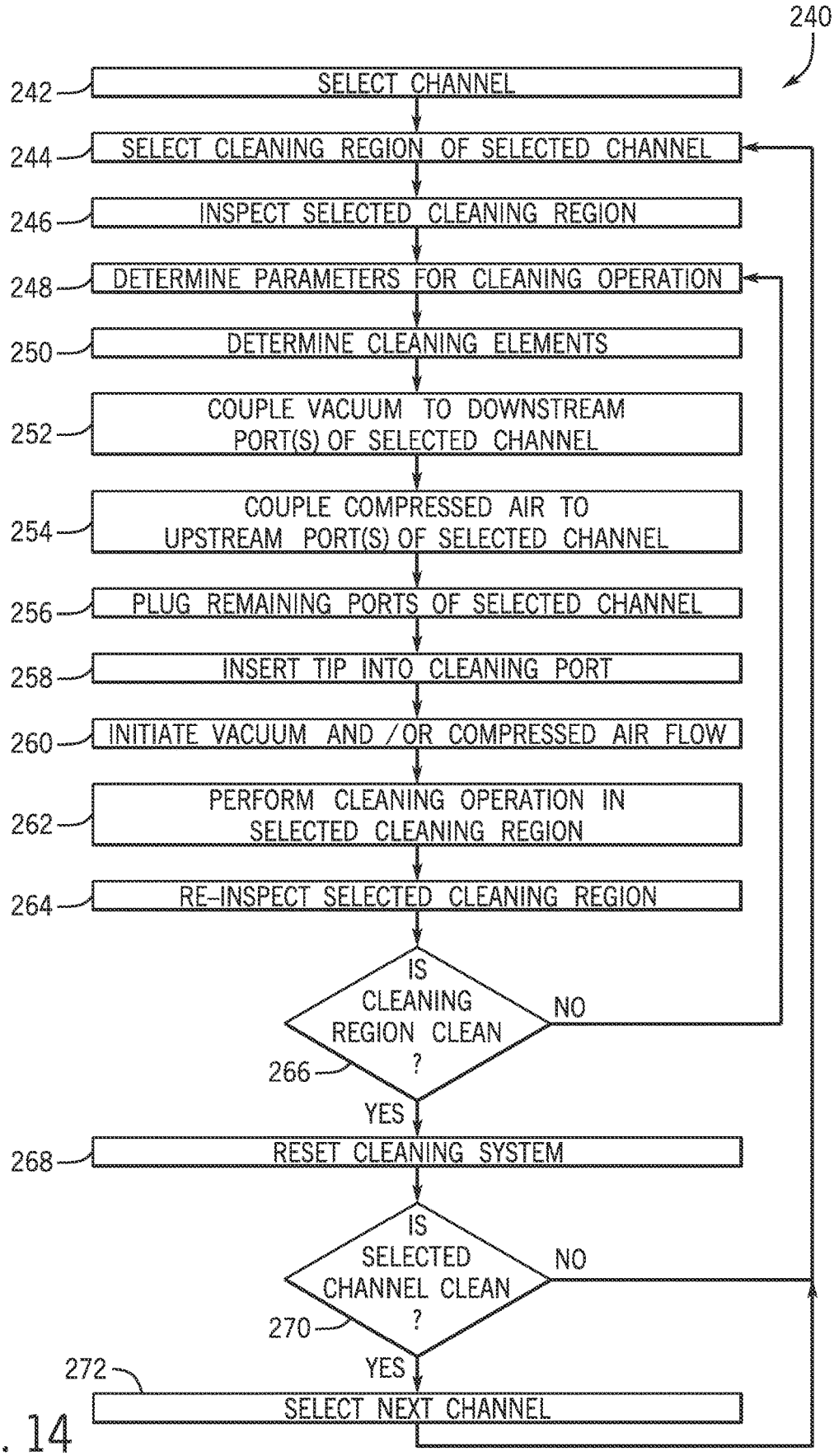
FIG. 14 illustrates an embodiment of an exemplary method for cleaning channels of a connector with the cleaning system.

FIG. 14 is a flow chart illustrating an exemplary embodiment of a method 240 for a maintenance interval to remove deposits from hydraulic channels, such as hydraulic channels of a connector 22 discussed above. To perform the method 240, one or more technicians may utilize the embodiments of the cleaning system 120 and the inspection system 121 during the maintenance interval to clean the hydraulic channels 68. The discussion of the method FIG. 12 below utilizes the channel 68 and ports 126, 128, 130, 132, 134 illustrated in FIG. 5 merely as an example. It may be appreciated that the method 240 may be utilized with other channels 68 and ports of a connector 22 or other component of the hydrocarbon extraction system 10.

Initially, the technician may select (block 242) the channel 68 (e.g., channel A, B, C, or D) to be inspected and cleaned. As discussed above, cleaning each channel includes, but is not limited to, loosening and removing deposits from the channel 68. The technician may then select (block 244) the cleaning region 138 and the cleaning port 137 of the selected channel 68. For example, upon selection (block 242) of the first channel 100 connected to cylinders II, IV, VI, VIII, and X, the technician selects (block 244) the first port 126 to be the cleaning port 137, and selects the cleaning region 138 to be between the first port 126 and the second port 128. The technician may then inspect (block 246) the selected cleaning region 138 from the cleaning port 137, such as by utilizing the inspection system 121. The technician and/or the inspection system 121 may note characteristics of the cleaning region 138 of the channel 68, including, but not limited to, the thickness of the deposits 116, the consistency (e.g., density, hardness) of the deposits 116, the composition of the deposits 116, the location of the deposits 116 along the cleaning region 138 (e.g., near the first port 126, near the second port 128), or the location of the deposits 116 in the cross-section of the channel 68 (e.g., top, side, bottom, corners), or any combination thereof. In some embodiments, the inspection system 121 records data (e.g., images, video) from the inspection of the cleaning region 138. The recorded data (e.g., pre-cleaning data) may be stored for comparison to subsequent inspection data (e.g., post-cleaning data) after the cleaning operation.

Based at least in part on the characteristics of the cleaning region 138 of the channel, the technician may determine (block 248) the parameters for the cleaning operation. The determined parameters may include, but are not limited to, a sweep direction (e.g., upstream, downstream) that the tip 136 is to sweep through the cleaning region 138, the diameter 152 of the flexible cable 124, rotation direction of the flexible cable 124 about the cable axis, the feed rate of the flexible cable 124 and the tip 136 through the cleaning region 138, pulse duration and frequency of rotation of the flexible cable 124, the rotational rate of the flexible cable 124 and the tip 136, the quantity of passes through the cleaning region 138 before re-inspection, the use of the vacuum system 142, a vacuum pressure of the vacuum system 142, the use of the pressurized fluid supply 144, a pressure of the pressurized fluid flow 146 (e.g., airflow), or a flow rate of the pressurized fluid flow 146 (e.g., airflow), or any combination thereof. The technician may also determine (block 250) the cleaning tip 136 to couple with the rotary tool 122. As discussed above with FIGS. 6-10, the technician may select a tip 136 based at least in part on the thickness of the deposits, the location of the deposits, the shape of the channel 68, or movement (e.g., sweep direction) of the flexible cable 124 within the channel 68, or any combination thereof. Additionally, the technician may determine (block 250) whether the flexible cable 124 has cleaning elements 192 disposed along the cleaning length 210, as discussed with FIG. 11.

If it is determined that the cleaning operation will utilize the vacuum system 142, the technician couples (block 252) the vacuum system 142 to one or more ports (e.g., second port 128, the third port 130, the fourth port 132) downstream 140 of the cleaning port 137 via the manifold 143. Likewise, if it is determined that the cleaning operation will utilize the pressurized fluid supply 144, the technician couples (block 254) the pressurized fluid supply 144 to one or more ports (e.g., fifth port 134, fourth port 132) upstream 141 of the cleaning port 137 via the flow connector 169. The low pressure of the vacuum system 142 draws loosened deposits downstream 140 to ports coupled to the vacuum system 142, thereby removing the deposits 116 from the channel 68. Likewise, the pressurized airflow 146 from the pressurized air supply 144 urges loosened deposits 116 downstream 140 from the cleaning port 137. In some embodiments, the technician may plug (block 256) ports not coupled to the vacuum system 142 or to the pressurized air supply 144 to increase forces from the induced airflow on the loosened deposits 116. In some embodiments, the flow rate and/or pressure of the pressurized airflow 146 from the pressurized air supply 144 may vary during the cleaning operation. For example, pulsing the flow rate and/or the pressure of the pressurized airflow 146 may facilitate loosening or removal of deposits 116 from the channel 68.

The technician inserts (block 258) the tip 136 of the flexible cable 124 into the cleaning port 137 towards the cleaning region 138. In some embodiments, inserting the tip 136 into the cleaning port 137 includes positioning the sleeve 154 radially between the flexible cable 124 and walls of the cleaning port 137 to reduce or eliminate wear of the cleaning port 137, the flexible cable 124, or both. Additionally, or in the alternative, prior to insertion (block 258) of the tip into the selected channel 68, deposits in or near the cleaning port 137 may be manually removed with the tip 136, a scribing tool, or any combination thereof. Based at least in part on the determination of block 248, the vacuum system 142 and/or the pressurized air supply 144 can be initiated (block 260) to urge loosened deposits within the cleaning region 138 of the selected channel downstream 140 towards the second port 128 for removal. The vacuum system 142 and/or the pressurized air supply 144 may induce the airflow 146 that urges the loosened deposits 116 downstream 140 to be removed through a port.

The technician performs (block 262) the cleaning operation in the selected cleaning region 138 as discussed above. During the cleaning operation, the rotary tool 122 rotates the flexible cable 124 and the tip 136 at speeds between approximately 50 to 5000 RPM, although other speeds are possible. The flexible cable 124 and the tip 136 rotate within the cleaning region 138 of the selected channel 68, scraping and/or impacting deposits located therein. The rotational speed and the flexible nature of the flexible cable 124 enable the prongs 176 and/or the bristles 192 of tip 136 to interact with and loosen deposits at substantially all locations within the cleaning region 138 of the channel. That is, as the flexible cable 124 rotates within the cleaning region 138, the tip 136 may move (e.g., flail, thrash) about the cleaning region 138 in an erratic or irregularly manner, thereby interfacing with deposits within the cleaning region 138 from various angles. Furthermore, during the cleaning operation, the technician may move (e.g., sweep) the flexible cable 124 and the tip 136 downstream 140 and/or upstream 141 along the length 139 of the cleaning region 138 in one or more passes. The quantity of passes along the length 139 of the cleaning region 138 and the rate at which technician moves the tip 136 along the length 139 of the cleaning region 138 may be based at least in part on the determined parameters of block 248.

Loosened deposits 116 within the cleaning region 138 of the selected channel may be urged to the downstream end of the cleaning region 138 by one or more forces. For example, the loosened deposits 116 may be urged downstream by the tip 136, by the pressurized fluid flow 146 (e.g., airflow) from the pressurized fluid supply 144 via one or more upstream ports, or by the pressurized fluid flow 146 induced by the relatively low pressure of the vacuum system 142 via one or more downstream ports, or any combination thereof. In some embodiments, the vacuum system 142 and/or the pressurized fluid supply 144 are initiated (block 260) after the cleaning operation is performed (block 262) to urge downstream the deposits that were loosened during the cleaning operation. That is, the vacuum system 142 and/or the pressurized air supply 144 may be initiated (block 260) prior to, during, or after performance (block 262) of the cleaning operation for the selected cleaning region 138.

Upon completion of a determined quantity of passes (e.g., 1, 2, 3, 4, 5, 6, 7, 8, 9, 10 or more) along the length 139 of the cleaning region 138, the technician may re-inspect (block 264) the selected cleaning region 138, such as by utilizing the inspection system 121. The technician and/or the inspection system 121 may note characteristics of the cleaning region 138 of the channel, including, but not limited to, the thickness of any remaining deposits 116, the location of any remaining deposits 116 along the cleaning region 138, or the location of any remaining deposits 116 in the cross-section of the channel, or any combination thereof. In some embodiments, the inspection system 121 records data (e.g., images, video) from the re-inspection of the cleaning region 138. The recorded data (e.g., post-cleaning data) may be compared to previously acquired data (e.g., pre-cleaning data) from before the cleaning operation of block 262, such as from block 246. At node 266, the technician may determine based at least in part on the re-inspection of block 264 whether the cleaning region 138 is sufficiently clean. That is, the technician may determine whether enough of the deposits within the cleaning region 138 have been removed. In some embodiments, the technician determines (node 266) that the cleaning region 138 is sufficiently clean if any remaining deposits obstruct less than approximately 25, 15, 10, 5, or 1 percent of the cross-section of the cleaning region 138. If the cleaning region 138 is not sufficiently clean, then one or more blocks 248-264, as discussed above, may be repeated for the same cleaning region 138 until the cleaning region 138 is sufficiently clean.

If the cleaning region 138 is determined to be sufficiently clean, then the technician resets (block 268) the cleaning system 121. Resetting the cleaning system 121 may include decoupling the vacuum system 142 and/or the pressurized fluid supply 144 from ports of the selected channel. In some embodiments, plugs inserted at block 256 are removed from ports of the selected channel 68. Furthermore, the flexible cable 124 and the tip 136 can be removed from the cleaning region 138 via the cleaning port 137. As discussed above, each channel 68 may be fluidly coupled to each of the cylinders 64 of the connector 22, or only to a subset of the cylinders 64 of the connector 22. Accordingly, only ports of the selected channel 68 may interface with the cleaning system 121 during iterations of blocks 244-268. The technician determines (node 270) if the selected channel 68 is sufficiently clean. For example, the selected channel 68 may be sufficiently clean after performing (block 262) the cleaning operation along substantially the entire selected channel 68 over one or more iterations of blocks 244-264. If the selected channel 68 is not sufficiently clean, then the technician returns to block 244 to select the next cleaning region 138 of the selected channel 68.

In some embodiments, the next cleaning region 138 may be accessed via the same cleaning port 137 as the previous cleaning region 138. For example, where the first cleaning region is between the first port 126 and the second port 128 with the first port 126 utilized as the cleaning port 137, the second cleaning region is between the first port 126 and the fifth port 134 with the first port 126 utilized as the cleaning port 137. If the selected channel 68 has been determined (node 270) to be sufficiently cleaned, the next channel 68 can be selected (block 272) and blocks 244-264 can be repeated. The cleaning method 240 can be repeated for each channel 68 of the connector 22 until each of the channels 68 is determined (node 270) to be sufficiently cleaned. Upon determination that a channel 68 is sufficiently cleaned, a cleaning report may be generated to summarize the cleaning operations performed, the condition of the respective channel prior to the cleaning operations, and the condition of the respective channel 68 after the cleaning operation. The cleaning report may be generated by the cleaning system, inspection system, or technician, or any combination thereof.

The cleaning system and the method described herein enable one or more technicians to loosen and remove deposits from channels via access through the ports without destructively disassembling the component (e.g., connector). That is, the cleaning system and the method described herein facilitate the cleaning of the channels during a maintenance interval via existing access points (e.g., ports) without adding additional access points via cutting into the component (e.g., connector) to access the channels. As may be appreciated, reassembly of the component after destructive disassembly may increase the duration that the component is out of service. Additionally, or in the alternative, reassembly of the component after destructive disassembly via welding may increase skilled labor costs. Moreover, inspection and/or certification of the reassembly may increase the out of service duration and costs of the maintenance interval. In some embodiments, the cleaning system and the method described herein may enable one or more technicians to loosen and remove deposits from channels 68 in less than approximately 5, 4, 3, 2, 1, or 0.5 working days.

This written description uses examples to disclose the subject matter, including the best mode, and also to enable any person skilled in the art to practice the disclosed subject matter, including making and using any devices or systems and performing any incorporated methods. The patentable scope of the disclosed subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method comprising:

inserting a flexible cable into a cleaning region of a channel of a hydraulic connector component included in a hydrocarbon extraction system, the flexible cable inserted into the cleaning region via a cleaning port of the hydraulic connector component, wherein the flexible cable comprises an axis, a sleeve, and a plurality of tips, and a diameter of the plurality of tips is different than a diameter of the flexible cable, wherein the flexible cable is formed from a plurality of axially connected sections and the plurality of tips are coupled to the flexible cable via a clamp;

radially positioning the sleeve between the flexible cable and a wall of the cleaning port to reduce wear within the cleaning port when the flexible cable is rotated;

rotating the flexible cable about the axis within the channel to interact the plurality of tips with deposits disposed within the cleaning region of the channel, wherein the plurality of tips are configured to loosen portions of the deposits;

moving the flexible cable within the cleaning region of the channel along a length of the channel; and removing the portions of the deposits from the cleaning region of the channel via a second port.

2. The method of claim 1, wherein moving the flexible cable comprises pivoting a scraping element coupled to the flexible cable about a point of the flexible cable, the plurality of tips comprises the scraping element, and the scraping element comprises one or more prongs.

3. The method of claim 1, comprising:

coupling a vacuum system to the second port, wherein the second port is downstream of the cleaning port relative to a direction the flexible cable is inserted into the channel; and controlling the vacuum system to provide a low pressure region at the second port while rotating the flexible cable about the axis within the channel, and the low pressure region is configured to draw the portions of the deposits to the second port.

4. The method of claim 3, comprising:

coupling the vacuum system to a third port downstream of the cleaning port and the second port, wherein the vacuum system comprises a manifold coupled to the second port and the third port; and controlling the vacuum system to provide the low pressure region at the second port and the third port.

5. The method of claim 1, comprising:

coupling a pressurized fluid supply to a third port upstream of the cleaning port relative to a direction the flexible cable is inserted into the channel; and supplying a pressurized airflow from the third port to the second port downstream of the cleaning port while rotating the flexible cable about the axis within the channel, wherein the pressurized airflow is configured to urge the portions of the deposits downstream.

6. The method of claim 1, comprising determining one or more first characteristics of the deposits within the cleaning region of the channel, wherein the one or more first characteristics of the deposits comprises a thickness of the deposits, a consistency of the deposits, an axial location of the deposits along the length of the cleaning region, a cross-sectional location of the deposits in the cleaning region, or any combination thereof.

7. The method of claim 6, comprising determining parameters for rotating and moving the flexible cable based at least in part on the determined one or more characteristics of the deposits within the cleaning region, wherein the parameters comprise at least one of a sweep direction of the plurality of tips through the cleaning region, a movement rate of the flexible cable and the plurality of tips along the length of the cleaning region, the rotational rate of the flexible cable and the plurality of tips, a quantity of sweeps of the plurality of tips along the length, utilization of a vacuum system, and utilization of a pressurized air system.

8. The method of claim 7, comprising:

determining one or more second characteristics of the deposits within the cleaning region of the channel after rotating and moving the flexible cable within the cleaning region of the channel; and comparing the one or more second characteristics of the deposits within the cleaning region of the channel to the one or more first characteristics of the deposits within the cleaning region of the channel.

9. The method of claim 1, wherein the sleeve is formed of metal.

10. The method of claim 1, wherein the sleeve is formed of ceramic.

11. The method of claim 1, wherein a length of the sleeve is greater than a length of the cleaning port.

* * * * *